US008348620B2

(12) United States Patent
Dejaune et al.

(10) Patent No.: US 8,348,620 B2
(45) Date of Patent: Jan. 8, 2013

(54) DEVICE FOR AXIALLY RETAINING BLADES MOUNTED ON A TURBOMACHINE ROTOR DISK

(75) Inventors: Claude Gerard Rene Dejaune, Boissise la Bertrand (FR); Valerie Annie Gros, Grisy Suisnes (FR); Gael Loro, Combs la Ville (FR); Jean-Luc Soupizon, Vaux le Penil (FR)

(73) Assignee: SNECMA, Paris (FR)

( * ) Notice: Subject to any disclaimer, the term of this patent is extended or adjusted under 35 U.S.C. 154(b) by 997 days.

(21) Appl. No.: 12/145,882

(22) Filed: Jun. 25, 2008

(65) Prior Publication Data

US 2009/0004018 A1 Jan. 1, 2009

(30) Foreign Application Priority Data

Jun. 27, 2007 (FR) ..... 07 56062

(51) Int. Cl.
*F01D 5/32* (2006.01)

(52) U.S. Cl. ..... 416/220 R; 416/218

(58) Field of Classification Search ..... 416/219 R, 416/220 R, 215, 218

See application file for complete search history.

(56) References Cited

U.S. PATENT DOCUMENTS

| | | | | | |
|---|---|---|---|---|---|
| 2,751,189 | A | * | 6/1956 | Ledwith | 416/217 |
| 3,181,835 | A | * | 5/1965 | Davis | 416/145 |
| 3,853,425 | A | * | 12/1974 | Scalzo et al. | 416/95 |
| 3,888,601 | A | * | 6/1975 | Glassburn | 416/144 |
| 4,019,833 | A | * | 4/1977 | Gale | 416/220 R |
| 4,645,425 | A | * | 2/1987 | Morrison, Jr. | 416/215 |
| 4,648,799 | A | | 3/1987 | Brown et al. | |
| 4,730,983 | A | * | 3/1988 | Naudet et al. | 416/220 R |
| 5,173,024 | A | * | 12/1992 | Mouchel et al. | 416/220 R |
| 5,211,407 | A | * | 5/1993 | Glynn et al. | 277/632 |
| 5,244,348 | A | * | 9/1993 | Karls et al. | 416/204 R |
| 5,256,035 | A | * | 10/1993 | Norris et al. | 416/220 R |
| 5,518,369 | A | | 5/1996 | Modafferi | |
| 5,622,476 | A | * | 4/1997 | Adde et al. | 416/221 |
| 6,951,448 | B2 | * | 10/2005 | Duesler et al. | 416/220 R |
| 8,128,371 | B2 | * | 3/2012 | Ravi et al. | 416/212 R |

FOREIGN PATENT DOCUMENTS

| | | | |
|---|---|---|---|
| EP | 1 180 580 | A1 | 2/2002 |
| EP | 1 498 579 | A1 | 1/2005 |
| EP | 1 703 081 | A1 | 9/2006 |
| WO | WO 2007/014543 | A1 | 2/2007 |

* cited by examiner

*Primary Examiner* — Douglas King

(74) *Attorney, Agent, or Firm* — Oblon, Spivak, McClelland, Maier & Neustadt, L.L.P.

(57) ABSTRACT

A device for axially retaining blades mounted on a turbomachine rotor disk is disclosed. The device includes a rotor disk having a plurality of slots and a flange extending radially outwards, cooperating with a bearing face of the disk to define a groove that is open radially outwards. The device also includes a plurality of blades, each having a root mounted in a slot of the disk, each blade root having a respective radial bearing face that corresponds to the bearing face of the disk and that has at least one nib extending radially inwards thereover to define a notch that is open radially inwards, and a retaining ring that is mounted against the bearing faces of the disk and of the blade roots. The retaining ring is housed in the groove of the disk, is held outwardly in the notches of the blade roots, and is constituted by a plurality of angular segments placed end to end.

7 Claims, 2 Drawing Sheets

DEVICE FOR AXIALLY RETAINING BLADES MOUNTED ON A TURBOMACHINE ROTOR DISK

BACKGROUND OF THE INVENTION

The present invention relates to a device for axially retaining blades mounted on a turbomachine rotor disk such as the rotor of the last stage of the low pressure turbine.

In known manner, the low pressure turbine of a turbomachine comprises a plurality of stages of rotor blades alternating with stator vanes. For each stage of the turbine, the stationary vanes are fastened to two concentric shrouds and the rotor blades are fastened via their roots onto a rotor disk. All of the rotor disks of the turbine are fastened to one another by bolted connections and they are secured to the low pressure shaft of the turbomachine via a trunnion.

It is also known that the disk of the last stage of such a low pressure turbine has at its periphery a plurality of axial slots, each of which has mounted therein the root of one of the rotor blades of the turbine. The gas stream that passes through the turbine exerts an axial force on the rotor blades, so it is necessary to prevent any axial displacement of the blades by means of retaining devices. One such device consists in preventing the blade roots from moving with the help of an annular end plate that is pressed against a radial bearing face of the disk and of the blade roots, the end plate being held in this position by an annular keeper ring. By way of example, reference can be made to the publications EP 1 180 580 and EP 1 498 579. Although it is effective, such a device is usually complex to make and to mount since it makes use of several parts (specifically the end plate and the end plate keeper ring).

It is also known that the rotor disks of the low pressure turbine of a turbomachine are subject to a poor distribution of weight because their center of gravity does not lie on the axis of rotation. In order to correct such an unbalance phenomenon, balance weights are positioned at certain locations on the disk, in particular at the bolted connections between the various disks of the turbine and at flanges that are added specifically for this purpose.

Unfortunately, certain low pressure turbine configurations make access to the bolted connections impossible without previously dismantling some of the stages of the turbine. Furthermore, adding specific flanges for fastening balance weights increases the total weight of the turbine.

OBJECT AND SUMMARY OF THE INVENTION

The present invention seeks to remedy the above-mentioned drawbacks by proposing a device for axially retaining blades, which device is simple to make and to mount, and can also contribute to balancing the rotor disk.

This object is achieved by a device for axially retaining blades mounted on a turbomachine rotor disk, the device comprising: a rotor disk comprising: at its periphery, a plurality of substantially axial slots that are outwardly open; and on a radial bearing face, a flange extending radially outwards to co-operate with said bearing face to define an annular groove that is open radially outwardly; a plurality of blades, each comprising a root mounted in a corresponding slot of the rotor disk, each blade root being provided, on a radial bearing face thereof that corresponds to the bearing face of the rotor disk, with at least one nib extending radially inwards so as to co-operate with said bearing face of the blade root to define an annular notch that is open radially inwards; and a retaining ring mounted against the bearing faces of the rotor disk and of the blade roots, said retaining ring being housed in the groove of the disk, being held outwardly in the notches of the blade roots, and being constituted by a plurality of angular segments placed end to end.

Since the device of the invention comprises a single part (i.e. the retaining ring, which is itself segmented), it is easy to make and easy to mount on the rotor disk. Furthermore, since the retaining ring is constituted by a plurality of angular segments placed end to end, it is possible to vary individually the weights of each of these segments so as to correct the unbalance phenomenon encountered by rotor disks. As a result, unbalance correction can be obtained without it being necessary to begin by dismantling a structural connection. Furthermore, there is no need to add flanges dedicated to fastening balance weights and constituting extra overall weight.

According to an advantageous characteristic of the invention, at least one of the segments of the retaining ring possesses weight that is greater than that of the other segments.

According to another advantageous characteristic of the invention, each segment of the retaining ring includes outwardly open cutouts so as to enable the nibs of the blade roots to pass therethrough while mounting the retaining ring in the groove of the rotor disk.

According to yet another advantageous characteristic of the invention, the retaining ring includes means for preventing the ring from turning in the groove of the rotor disk. Thus, at least one of the segments of the retaining ring may include a foldable tongue that is suitable for being folded out between two adjacent nibs of the blade roots to prevent the retaining ring from turning in the groove of the rotor disk.

The invention also provides a turbomachine including at least one device as defined above for axially retaining blades mounted on a rotor disk.

BRIEF DESCRIPTION OF THE DRAWINGS

Other characteristics and advantages of the present invention appear from the following description with reference to the accompanying drawings that show an embodiment having no limiting character. In the figures.

DETAILED DESCRIPTION OF EMBODIMENTS

Figure 1:
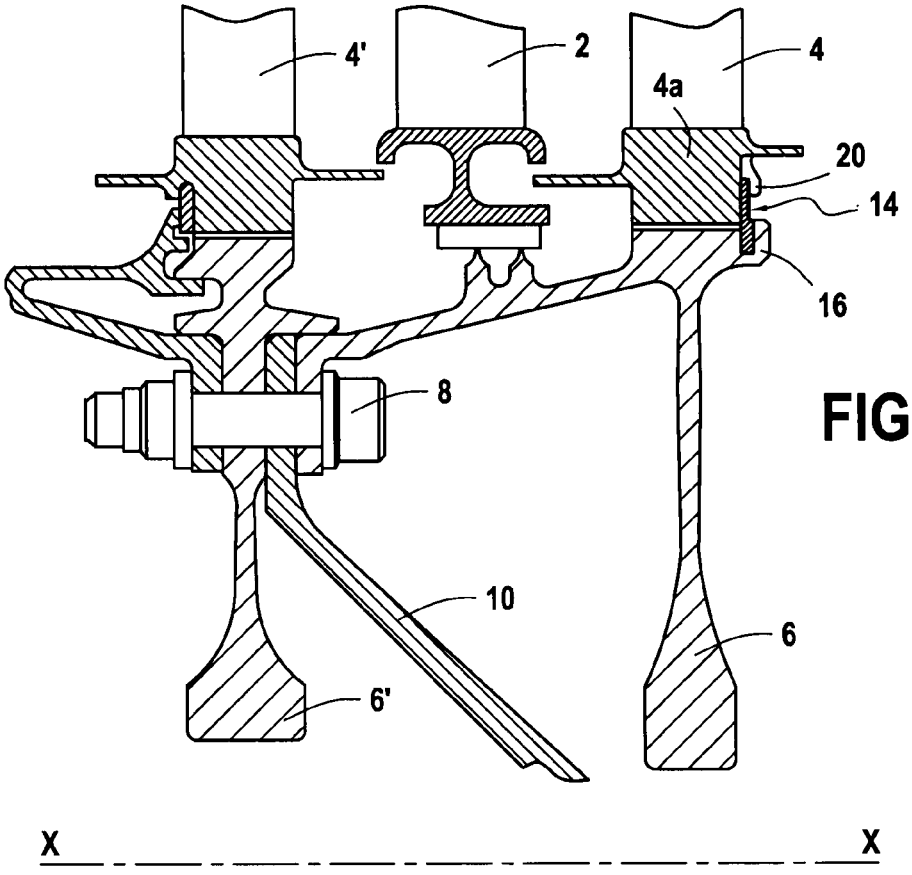
FIG. 1 is a fragmentary longitudinal section view of a low-pressure turbine in a turbomachine and fitted with a device constituting an embodiment of the invention.
Figure 1A:
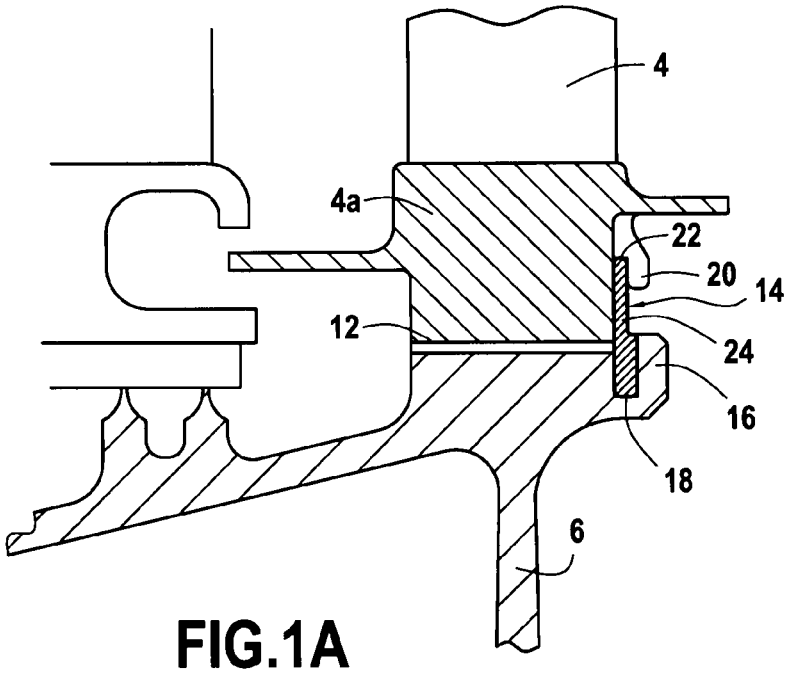
FIG. 1A is a detail view on a larger scale of FIG. 1.

FIGS. 1 and 1A are fragmentary longitudinal section views of a low-pressure turbine of an aviation turbomachine fitted with a device constituting an embodiment of the invention.

Naturally, the present invention applies to any other turbomachine assembly (for aviation or terrestrial uses) provided with a rotor disk having blades mounted thereon by being moved axially.

The low-pressure turbine is centered on the longitudinal axis X-X of the turbomachine. The last stage of the turbine comprises a nozzle formed by a plurality of stator vanes 2 and by a rotor wheel placed behind the nozzle and formed by a plurality of rotor blades 4 mounted axially on a rotor disk 6. The last-but-one stage of the turbine also has a nozzle (not shown) and a rotor wheel formed by a plurality of rotor blades 4' mounted on a rotor disk 6'.

The disks 6 and 6' of the last and last-but-one stages of the turbine are fastened to each other by bolted connections 8, and they are secured to the low pressure shaft of the turbomachine (not shown) by an annular trunnion 10. The trunnion is also fastened to the disks 6 and 6' by means of the same bolted connections 8.

As shown in FIG. 1A, the disk 6 of the last stage of the turbine has at its periphery a plurality of slots 12 that extend substantially axially, and that open to the outside of the disk (i.e. away from the longitudinal axis X-X), each of which is designed to receive axially the root 4*a* (e.g. of fir-tree shape) of a rotor blade 4 of the turbine (e.g. by being engaged therein).

The disk 6 also has a flange 16 on its downstream radial face 14 (referred to below as its bearing face), which flange 16 extends radially towards the outside of the disk so as to co-operate with the bearing face to define an outwardly-open annular groove 18.

Each blade root 4*a* is also provided in its downstream radial face corresponding to the downstream radial face of the rotor disk 6 with at least one nib 20 extending radially towards the inside of the disk (i.e. towards the longitudinal axis X-X) to co-operate with said downstream face to define an annular notch 22 that is inwardly open.

The device of the invention includes a retaining ring 24 that is mounted against the bearing face 14 of the rotor disk 6 and against the blade roots 4*a*. The retaining ring 24 is housed in the groove 18 of the disk and it is held on the outside in the notches 22 of the blade roots 4*a*.

In addition, the retaining ring 24 is constituted by a plurality of angular segments (or sectors) 24*a* that are placed end to end, each ring segment 24*a* possibly extending circumferentially over the same angular distance.

By way of example, for a low pressure turbine of a turbomachine in which the last stage has ninety-eight rotor blades, it is possible to provide fourteen ring segments 24*a*, such that each of them extends over 25°.

Figure 2A:
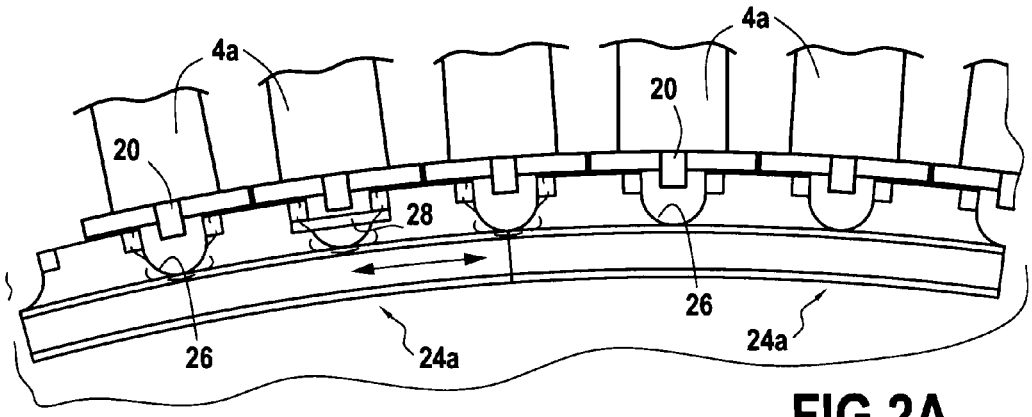
FIGS. 2A and 2B are fragmentary front views of the FIG. 1 device showing how the retaining ring is mounted.

To enable them to be mounted in the groove 18 of the disk 6, each ring segment 24*a* includes cutouts 26 that are outwardly open. As shown in FIG. 2A, these cutouts are dimensioned so as to allow the nibs 20 of the blade roots 4*a* to pass while the retaining ring is being mounted in the disk groove. In this position, the ring segments are thus not held outwardly in the notches 22 of the blade roots.

Still by way of example, when the rotor disk 6 has ninety-eight rotor blades 4 and the retaining ring 24 is constituted by fourteen segments 14*a*, the number of cutouts 26 per segment can be seven.

Figure 2B:
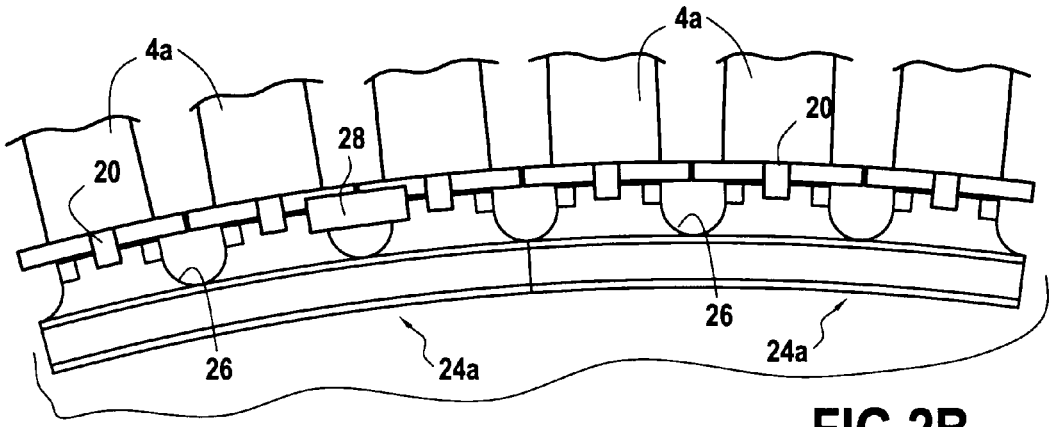

Once mounted in the groove 18 of the disk, the ring segments 24*a* are turned about the longitudinal axis X-X of the turbomachine in such a manner that the nibs 20 of the blade roots are no longer in register with the cutouts 26 (FIG. 2B). In this position, the ring segments are then held outwardly in the notches of the blade roots.

Still by way of example, when the rotor disk 6 has ninety-eight rotor blades 4 and the retaining ring 24 is made up of fourteen segments 24*a*, each segment having seven cutouts 26, turning the retaining ring through 1.8° (in either direction) serves to pass from the position shown in FIG. 2A to the position shown in FIG. 2B.

Naturally, the retaining ring is disassembled in the same manner by turning it through an angle that is sufficient to bring the nibs of the blade roots back into register with the cutouts in the ring segments.

In an advantageous disposition of the invention, at least one of the ring segments 24*a* includes a foldable tongue 28 that is suitable for being folded out between two adjacent nibs 20 of the blade roots 4*a* so as to prevent the retaining ring from turning in the groove 18 of the rotor disk 6 once it has been properly positioned therein (FIG. 2B).

Thus, in the embodiment of FIGS. 2A and 2B, the tongue 28 is placed level with one of the cutouts 26 of the ring segment 24*a* and is suitable on being folded to occupy two extreme positions: one position in which it extends in a plane that is inclined relative to the radial plane of the ring segments so as to allow said segments to turn (FIG. 2A), and another position in which it is disposed in the same radial plane as the nibs 20 of the blade roots and extends circumferentially between two adjacent nibs 20 so as to prevent said segments from turning, and thus prevent the entire retaining ring from turning (FIG. 2B).

It should be observed that there is no need for all of the ring segments to be fitted with such a tongue, a single tongue for all of the segments being sufficient to prevent said ring from turning.

In another advantageous disposition of the invention, at least one of the ring segments 24*a* possesses weight that is greater than that of the other segments.

Such a disposition makes it easy to correct the unbalance phenomenon that is observed in a low pressure turbine. Since the retaining ring 24 is segmented, it is possible to give individual weights to some of the ring segments that are different from the weight of the others so as to ensure that the center of gravity of the rotor disk does indeed lie on the longitudinal axis X-X of the turbomachine. It should be observed that the greater the number of ring segments, the more precisely can weight be balanced over the entire disk.

As shown in FIG. 1, this disposition is particularly advantageous when the annular space between the inner end of the disk 6 of the last stage of the turbine and the trunnion 10 prevents direct access to the bolted connections 8, thereby making it impossible to fasten balance weights to these bolted connections without it being necessary to begin by dismantling the last turbine stage.

In practice, the rotor disk is verified for balance after the turbine has been assembled, and where necessary unbalance correction is then applied. During the operation of correcting unbalance, one or more ring segments are replaced by segments of modified weight appropriate to the correction that is needed. The segments of modified weight are ring segments of weight that is greater than that of the other segments.

Figure 3A:
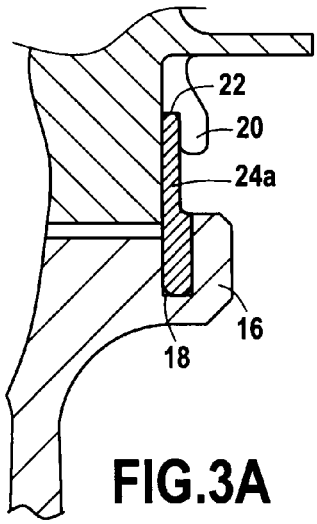
FIGS. 3A to 3C are longitudinal section views of devices constituting other embodiments of the invention.
Figure 3B:
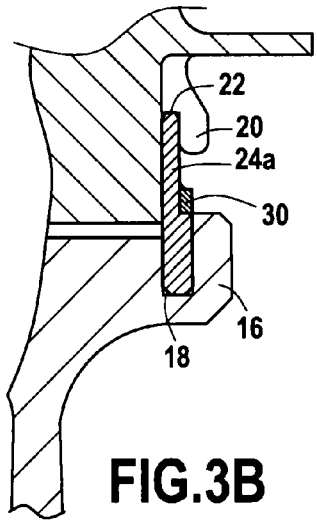
Figure 3C:
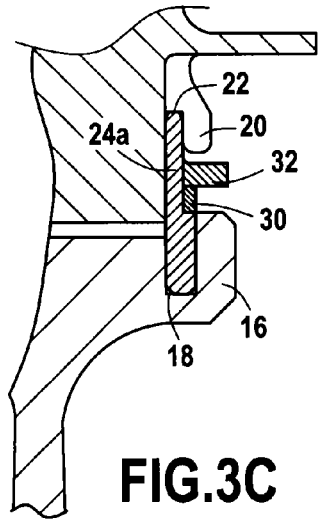

FIGS. 3A to 3C are longitudinal section views showing variant embodiments of the device in accordance with the invention, showing various ways of varying the weight of a ring segment 24*a*.

Thus, in the embodiment of FIG. 3B, the ring segment 24*a* presents extra thickness 30 compared with the segment shown in FIG. 3A. In addition to such extra thickness, the ring segment 24*a* of FIG. 3C presents a projection 32 that is present neither on the ring segment of FIG. 3A nor on the ring segment of FIG. 3B. This extra thickness 30 and this projection 32 can extend circumferentially over all of the ring segment, or over only part of it. They correspond to adding weight.

Other ways of varying the weight of the ring segments are also possible. Thus, the depths of the cutouts 26, and also the heights and/or the thicknesses of the zones between the cutouts can be varied so as to increase or decrease the weight of the ring segments.

It should be observed that the ring segments can be machined beforehand to comply with weight classes (e.g. gram by gram) so as to provide a wide selection of segments adapted to performing the necessary unbalance correction. Alternatively, ring segments can be machined on demand.

The device of the invention for axially retaining blades presents numerous advantages. In particular, it is constituted by a single main part (i.e. the retaining ring), thereby making it inexpensive to fabricate and easy to mount and/or remove relative to the bearing face of the disk. In addition, by using ring segments, it is possible to vary the weight of each of these segments and thus it is easy to correct the unbalance phenomenon that is observed with this type of technology.

What is claimed is:

1. A device for axially retaining blades mounted on a turbomachine rotor disk, the device comprising:

a rotor disk comprising:

a plurality of substantially axial slots disposed at an outer periphery of the rotor disk that are outwardly open; and on a radial bearing face, a flange extending radially outwards to co-operate with said bearing face to define an annular groove that is open radially outwardly;

a plurality of blades, each comprising a root mounted in a corresponding slot of the rotor disk, each blade root being provided, on a radial bearing face thereof that corresponds to the bearing face of the rotor disk, with at least one nib extending radially inwards so as to cooperate with said bearing face of the blade root to define an annular notch that is open radially inwards; and a retaining ring mounted against the bearing faces of the rotor disk and of the blade roots, said retaining ring being housed in the groove of the disk, the retaining ring being constituted by a plurality of angular segments placed end to end, each of the angular segments being a single piece assembly, wherein an outer circumference of each of the angular segments of the retaining ring is held in the notches of the blade roots and an inner circumference of each of the angular segments of the retaining ring is held in the groove of the disk, an upstream face of each of the angular segments of the retaining ring abuts a downstream face of the blade root and a downstream face of each of the angular segments of the retaining ring abuts an upstream inner face of the nib, and wherein the weight of at least one of the segments of the retaining ring being greater than that of the other segments, wherein the at least one of segments with a greater weight includes an extra thickness on the downstream face of segment, the extra thickness is provided radially above a radially outer face of the flange, and a projection extending axially in a downstream direction, the projection being provided radially above the extra thickness.

2. A device according to claim 1, wherein each of the annular segments of the retaining ring includes outwardly open cutouts so as to enable the nibs of the blade roots to pass therethrough while mounting the retaining ring in the groove of the rotor disk.

3. A device according to claim 1, wherein the retaining ring includes means for preventing the ring from turning in the groove of the rotor disk.

4. A device according to claim 3, wherein at least one of the annular segments of the retaining ring includes a foldable tongue that is suitable for being folded out between two adjacent nibs of the blade roots to prevent the retaining ring from turning in the groove of the rotor disk.

5. A turbomachine, including at least one device according to claim 1 for axially retaining blades mounted on a rotor disk.

6. A device according to claim 1, wherein the extra thickness extends circumferentially over all of the segment.

7. A device according to claim 1, wherein the extra thickness extends circumferentially over a portion of the segment.

* * * * *